US008768562B2

(12) United States Patent
Matsumoto

(10) Patent No.: US 8,768,562 B2
(45) Date of Patent: Jul. 1, 2014

(54) WORK MACHINE

(71) Applicant: Tadano Ltd., Kagawa (JP)

(72) Inventor: Naoyuki Matsumoto, Takamatsu (JP)

(73) Assignee: Tadano Ltd., Kagawa (JP)

( * ) Notice: Subject to any disclaimer, the term of this patent is extended or adjusted under 35 U.S.C. 154(b) by 0 days.

(21) Appl. No.: 13/803,853

(22) Filed: Mar. 14, 2013

(65) Prior Publication Data

US 2013/0253759 A1 Sep. 26, 2013

(30) Foreign Application Priority Data

Mar. 26, 2012 (JP) ..... 2012-068955

(51) Int. Cl.

| | |
|---|---|
| ***B66C 23/88*** | (2006.01) |
| ***B66F 11/00*** | (2006.01) |
| ***B66C 23/90*** | (2006.01) |
| ***B66F 11/04*** | (2006.01) |
| ***B66C 13/16*** | (2006.01) |

(52) U.S. Cl.

CPC ..... *B66C 23/905* (2013.01); *B66F 11/044* (2013.01); *B66C 13/16* (2013.01)

USPC ..... 701/31.1; 701/30.9; 701/34.4; 701/50; 212/276

(58) Field of Classification Search

CPC ..... B66C 23/905; B66C 13/16; B66F 11/044

See application file for complete search history.

(56) References Cited

U.S. PATENT DOCUMENTS

| | | | | | |
|---|---|---|---|---|---|
| 3,586,841 | A | * | 6/1971 | Griffin | 702/43 |
| 3,971,008 | A | * | 7/1976 | Nishizaki et al. | 340/522 |
| 4,057,792 | A | * | 11/1977 | Pietzsch et al. | 340/685 |
| 5,711,440 | A | | 1/1998 | Wada | |

FOREIGN PATENT DOCUMENTS

| | | | |
|---|---|---|---|
| EP | 2 202 194 | A1 | 6/2010 |
| GB | 2 050 294 | A | 1/1981 |
| JP | 08-282977 | * | 10/1996 |
| JP | 11-263583 | * | 9/1999 |
| JP | 2001-247300 | * | 9/2001 |
| JP | A-2001-240392 | | 9/2001 |
| JP | 2012-210990 | * | 11/2012 |

OTHER PUBLICATIONS

Extended Search Report issued in European Patent Application No. 13159018.4 dated Jun. 19, 2013.

* cited by examiner

*Primary Examiner* — Michael J Zanelli
(74) *Attorney, Agent, or Firm* — Oliff PLC

(57) ABSTRACT

A work machine with a boom that can be derricked, includes: a first derricking angle detector that detects a derricking angle of the boom at a base end of the boom; a second derricking angle detector that detects a derricking angle of the boom at a front end of the boom; a first flexible volume acquisition part that acquires a flexible volume of the boom based on a detected angle by the first derricking angle detector and a detected angle by the second derricking angle detector; a second flexible volume acquisition part that acquires a flexible volume of the boom based on the detected angle by the first derricking angle detector; and a switching part that switches between acquisition of the flexible volume of the boom by the first flexible volume acquisition part and acquisition of the flexible volume of the boom by the second flexible volume acquisition part.

12 Claims, 9 Drawing Sheets

WORK MACHINE

BACKGROUND

1. Technical Field

The present invention relates to a work machine having a boom that can be derricked, such as a mobile crane and an aerial work platform.

2. Related Art

Conventionally, a work machine having a boom that can be derricked has been known, which includes a first derricking angle detector that detects the derricking angle of a boom at the base end and a second derricking angle detector that detects the derricking angle of the boom at the front end, and calculates the flexible volume of the boom based on the detected angle by the first derricking angle detector and the detected angle by the second derricking angle detector (for example, see Patent Literature 1).

This work machine acquires the correct working radius by calculating the flexible volume of the boom, and controls the operation of the boom which is working, based on the load factor obtained by the rated load for the acquired working radius and the load acting on the front end of the boom.

Patent literature 1: Japanese Patent Application Laid-Open No. 2001-240392

Here, with the above-described work machine, when the second derricking angle detector fails due to the breaking of the electric circuit of the second derricking angle detector, which is constituted by a potentiometer and so forth, it is not possible to acquire the flexible volume of the boom, and therefore the operation of the boom is halted in order to ensure safety. In this case of the work machine, even if the first derricking angle detector normally works, the boom cannot be operated until the failure of the second derricking angle detector is resolved, and therefore the working efficiency of the work machine deteriorates significantly.

SUMMARY

It is therefore an object of the present invention to provide a work machine with sensors that detect the working state, where even if one sensor fails, the work machine can operate safely with another sensor.

To achieve the above-described object, a work machine with a boom that can be derricked, includes: a first derricking angle detector configured to detect a derricking angle of the boom at a base end of the boom; a second derricking angle detector configured to detect a derricking angle of the boom at a front end of the boom; a first flexible volume acquisition part configured to acquire a flexible volume of the boom based on a detected angle by the first derricking angle detector and a detected angle by the second derricking angle detector; a second flexible volume acquisition part configured to acquire a flexible volume of the boom based on the detected angle by the first derricking angle detector; and a switching part configured to switch between acquisition of the flexible volume of the boom by the first flexible volume acquisition part and acquisition of the flexible volume of the boom by the second flexible volume acquisition part when the flexible volume of the boom is acquired.

By this means, it is possible to acquire the flexible volume of the boom by one of the first flexible volume acquisition part and the second flexible volume acquisition part. Therefore, even if the second derricking angle detector cannot detect the derricking angle of the boom, it is possible to acquire the correct working radius of the boom based on the flexible volume of the boom, which is acquired by the second flexible volume acquisition part.

With the present invention, even if the second derricking angle detector cannot detect the derricking angle of the boom, it is possible to acquire the correct working radius of the boom based on the flexible volume of the boom, which is acquired by the second flexible volume acquisition part, and therefore continue the work safely and improve the working efficiency.

DESCRIPTION OF EXEMPLARY EMBODIMENTS

FIG. 1 to FIG. 8 show an embodiment of the present invention.

Figure 1:
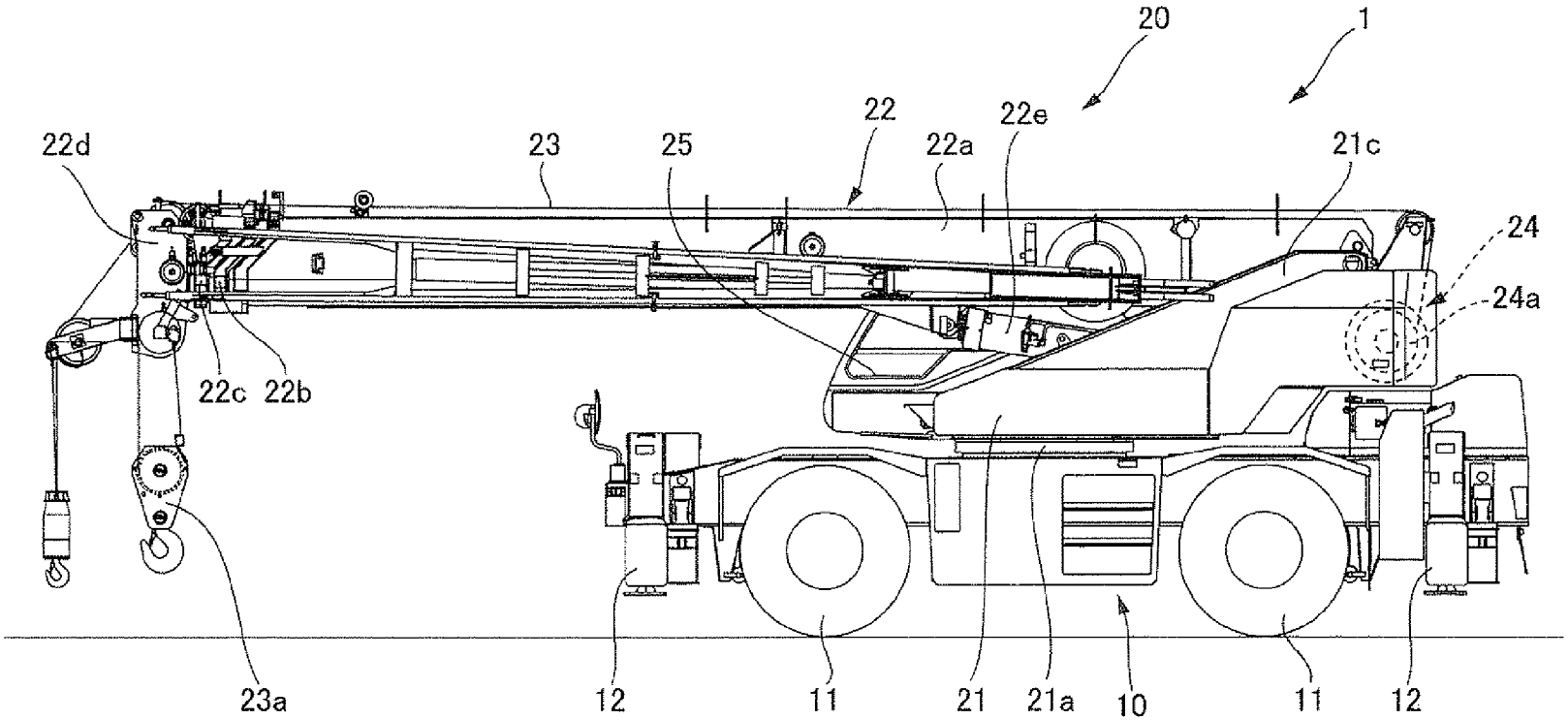
FIG. 1 is a side view showing a mobile crane according to an embodiment of the present invention.

A mobile crane 1, as a work machine according to the present invention, includes a vehicle 10 to run and a crane apparatus 20, as shown in FIG. 1.

The vehicle 10 has wheels 11 and runs by an engine E as a power source. In addition, outriggers 12 are provided on the right and left sides of the front part of the vehicle 10 and also on the right and left sides of the rear part of the vehicle 10 to prevent the vehicle 10 from overturning and support the vehicle 10 stably when the crane is working. Each outrigger 12 can move outward in the width direction and also be extended downward by a hydraulic jack cylinder 13 (see FIG. 2). The bottom ends of the outriggers 12 contact the ground to support the vehicle 10 on the ground stably.

The crane apparatus 20 includes a swivel base 21 pivotably provided in the center part of the vehicle 10 in the longitudinal direction and configured to be able to swivel on a horizontal plane; a boom 22 provided to be able to perform derricking movement with respect to the swivel base 21 and to perform telescopic motion; a wire rope 23 suspended from the front end of the boom 22; a winch 24 to reel and unreel the wire rope 23; and a cabin 25 provided before the swivel base 21 to run the vehicle 10 and operate the crane apparatus 20 to work.

The swivel base 21 is configured to be able to swivel with respect to the vehicle 10 by means of a ball bearing or roller bearing swivel support 21*a*. The swivel base 21 is driven by a hydraulic swivel motor 21*b* (see FIG. 2).

The boom 22 is constituted by a plurality of boom members 22*a*, 22*b*, 22*c* and 22*d* and formed as a telescopic boom in such a manner that the boom members 22*a*, 22*b* and 22*c* other than the top boom member 22*d* can accommodate the boom members 22*b*, 22*c*, and 22*d*, which are adjacent and anterior to the boom members 22*a*, 22*b* and 22*c*, respectively. The base end of the bottom boom member 22*a* is swingably connected to a bracket 21*c* of the swivel base 21. A hydraulic derricking cylinder 22*e* is connected between the boom member 22*a* and the bracket 21*c*, and stretches and shrinks to allow the boom 22 to perform the derricking movement. Meanwhile, a hydraulic telescopic cylinder 22*f* (see FIG. 22*f*) is provided in the bottom boom member 22*a*, and stretches and shrinks to allow the boom 22 to perform telescopic motion.

A snatch block 23*a* is connected to the front end of the wire rope 23 and hangs from the front end of the boom 22. Goods can be hooked by the snatch block 23*a*, and then suspended from the front end of the boom 22.

Figure 2:
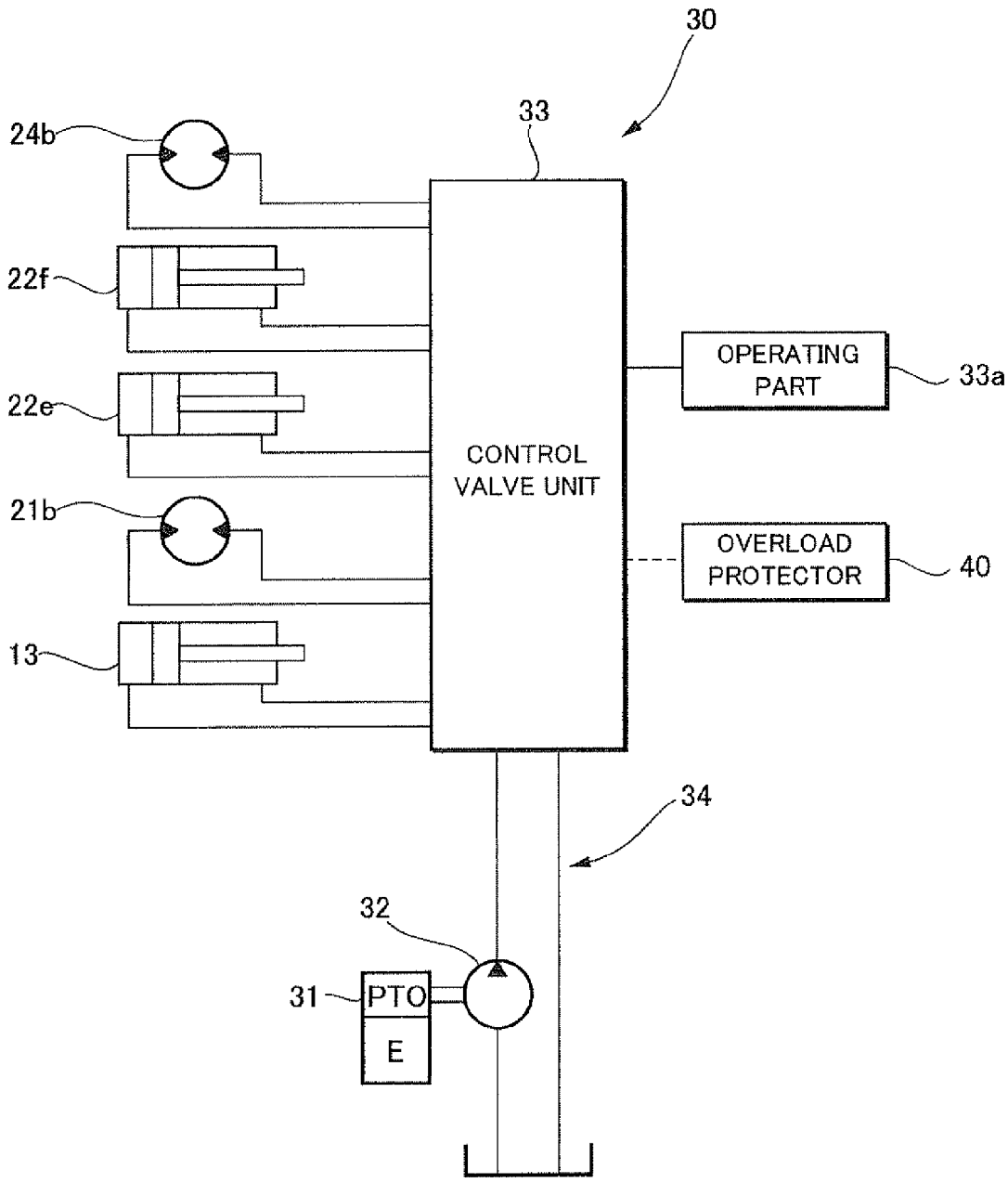
FIG. 2 is a schematic diagram showing a hydraulic supply device.

The winch 24 has a drum 24*a* around which the wire rope 23 is wound, which can rotate in forward and reverse directions by a hydraulic winch motor 24*b* (see FIG. 2).

The cabin 25 is provided lateral to the bracket 21*c* on the swivel base 21 and swivels with the swivel base 21.

Actuators, such as the jack cylinder 13, the swivel motor 21*b*, the derricking cylinder 22*e*, the telescopic cylinder 22*f* and the winch motor 24*b*, are activated by the supply or discharge of hydraulic oil. The hydraulic oil to activate each actuator is supplied by a hydraulic supply device 30 shown in FIG. 2.

The hydraulic supply device 30 includes: a PTO (power take-off) mechanism 31 that takes the power of the engine E for running the vehicle 10; a hydraulic pump 32 driven by the power of the engine E, which is taken from the PTO mechanism 31; and a control valve unit 33 to control the flow of the hydraulic oil discharged from the hydraulic pump 32. They are connected to a hydraulic oil circuit 34.

The control valve unit 33 includes a plurality of control valves corresponding to the actuators, respectively. The control valves can be operated by an operating part 33*a* such as an operating lever and an operating pedal. In addition, each of the control valves constituting the control valve unit 33 has a switching means such as a solenoid, and can be operated by a signal from an overload protector 40 described later.

The overload protector 40 is provided in the mobile crane 1 to prevent mobile crane 1 from being in a so-called overload state in which a load W1 acting on the front end of the boom 22 exceeds a rated load Wm according to the working conditions including the width of an outrigger 12 in the lateral direction, the swivel angle of the swivel base 21, and a derricking angle θ and a telescopic length L of the boom 22.

Figure 3:
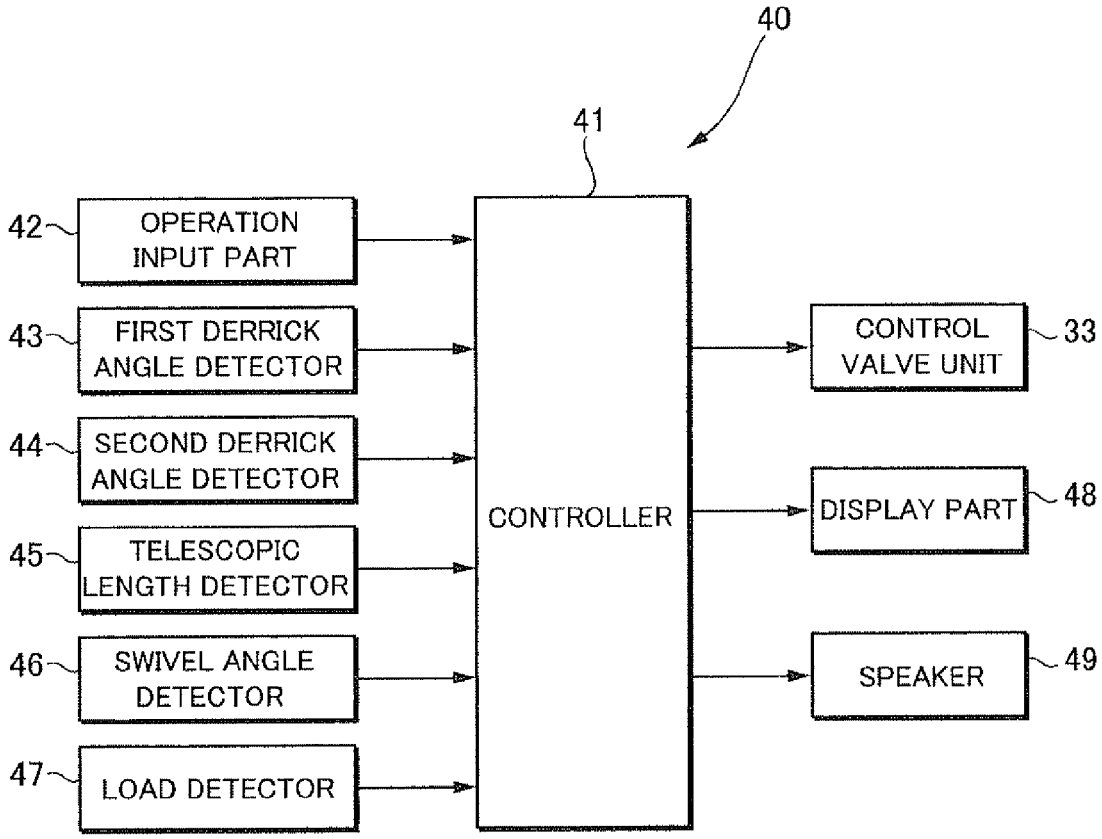
FIG. 3 is a block diagram showing the control system of an overload protector.

As shown in FIG. 3, the overload protector 40 has a controller 41 constituted by a CPU, a ROM, a RAM and so forth. When the controller 41 receives an input signal from the devices connected to its input side, the CPU reads a program stored in the ROM based on the input signal, stores the state detected by the input signal in the RAM, and transmits an output signal to the devices connected to its output side.

As shown in FIG. 3, the following components are connected to the input side of the controller 41: an operation input part 42 that is operated by the user to perform various settings for crane operation; a first derricking angle detector 43, which is a means for detecting the derricking angle of the base end of the bottom boom member 22*a*; a second derricking angle detector 44, which is a means for detecting the derricking angle of the front end of the top boom member 22*d*; a telescopic length detector 45 that detects the telescopic length of the boom 22; a swivel angle detector 46 that detects the swivel angle of the boom 22; and a load detector 47 that detects the load W1 acting on the front end of the boom 22.

Meanwhile, as shown in FIG. 3, the following components are connected to the output side of the controller 41: a control valve unit 33, a display part 48 such as a liquid crystal display that can display a setting state or an actual state of the boom 22; and a speaker 49 that sounds an error and gives an alarm.

The controller 41 stores a table representing the relationship between the working radius R and the rated load Wm of the boom 22. The controller 41 extracts the rated load Wm for the working radius R of the boom 22 from the table and calculates a load factor l that is a ratio of the actual load W1 acting on the front end of the boom 22 to the extracted rated load Wm ($l=W1/Wm\times100(\%)$). When the load factor l is over 100%, the controller 41 displays the overload state on the display part 48, sounds an alarm from speaker 49, and controls and restricts the crane operation.

The controller 41 calculates the working radius R of the boom 22 based on the derricking angle θ and the telescopic length L of the boom 22 ($R=L\cos\theta$). Since the boom 22 bends by its own weight, the controller 41 calculates the derricking angle θ, taking into consideration the flexure of the boom 22.

Figure 4:
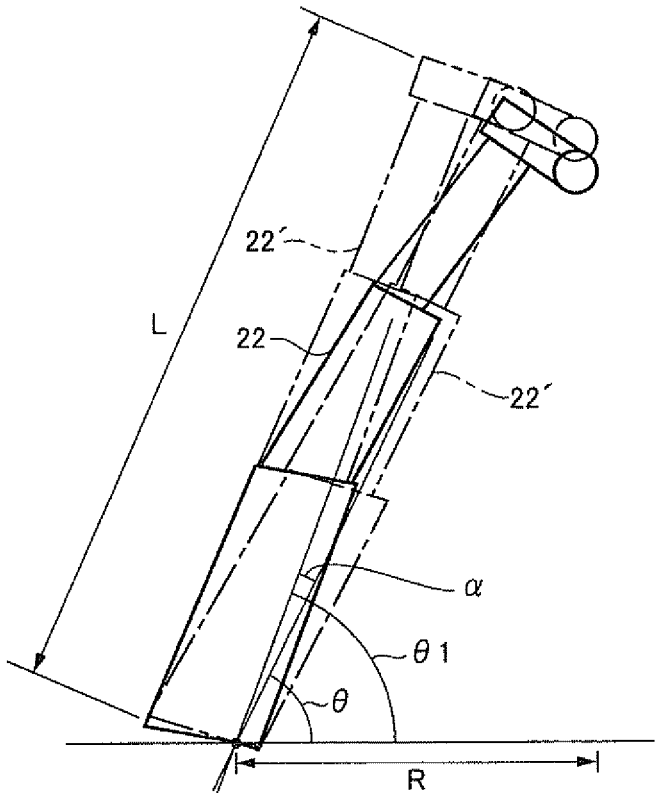
FIG. 4 is a schematic diagram showing the flexing angles of a boom.

As shown in FIG. 4, the derricking angle θ is acquired by calculating a flexing angle α as the flexible volume of the boom 22 when an inflexible virtual boom 22' (indicated by the two-dot chain line shown in FIG. 4) inclines such that the front end of the inflexible virtual boom 22' reaches the front end of the actual flexible boom 22 (the dashed-dotted line shown in FIG. 4), and by subtracting the flexing angle α from a detected angle θ1 by the first derricking angle detector 43 ($\theta=\theta1-\alpha$).

The flexing angle α of the boom 22 can be acquired by two methods, a first flexing angle acquisition method (hereinafter "first method") as a first means for acquiring the flexible volume of the boom 22 and a second flexing angle acquisition method (hereinafter "second method") as a second means for acquiring the flexible volume of the boom 22. With the first method, the flexing angle α of the boom 22 is acquired based on the detected angle θ1 by the first derricking angle detector 43 and a detected angle θ2 by the second derricking angle detector 44. Meanwhile, with the second method, the flexing angle α of the boom 22 is acquired based on the detected angle θ1 by the first derricking angle detector 43.

With the first method, the flexing angle α of the boom 22 is calculated by multiplying the difference (θ1−θ2) between the detected angle θ1 by the first derricking angle detector 43 and the detected angle θ2 by the second derricking angle detector 44 by a coefficient K ($\alpha=K(\theta1-\theta2)$).

Here, the coefficient K is a numeric value that is determined according to the telescopic length L of the boom 22 and the telescopic patterns of the boom 22 obtained by combining the lengths of the boom members 22*a*, 22*b*, 22*c* and 22*d* for the telescopic length L. For example, the longer the telescopic length L of the boom 22 is, the greater the flexing angle α is, so that the longer the telescopic length L of the boom 22 is, the greater the coefficient K is. Moreover, the boom 22 may have a plurality of telescopic patterns to have a predetermined telescopic length L, except the minimum telescopic length and the maximum telescopic length. For the same telescopic length L, the flexing angle α increases when a thinner boom member extends. Therefore, the coefficient K is greater in a telescopic pattern in which a boom member located in the front end side extends than in a telescopic pattern in which a boom member located in the base end side extends. This coefficient K is determined for each telescopic length L and each telescopic pattern of the boom 22, based on actual measurement or calculation. The controller 41 stores a table representing the relationship between the coefficients K, and the telescopic lengths L and the telescopic patterns of the boom 22.

With the second method, the flexing angle α of the boom 22 is acquired, which corresponds to the detected angle θ1 by the first derricking angle detector 43, the detected length L by the telescopic length detector 45, and the detected load by the load detector 47 is acquired, by using a table representing the relationship between the flexing angle α and the moment (the boom 22's own weight and the load of goods) acting around the base point from which the boom 22 performs derricking movement, for each condition (the telescopic length L and the derricking angle) of the boom 22 stored in the controller 41.

Figure 5:
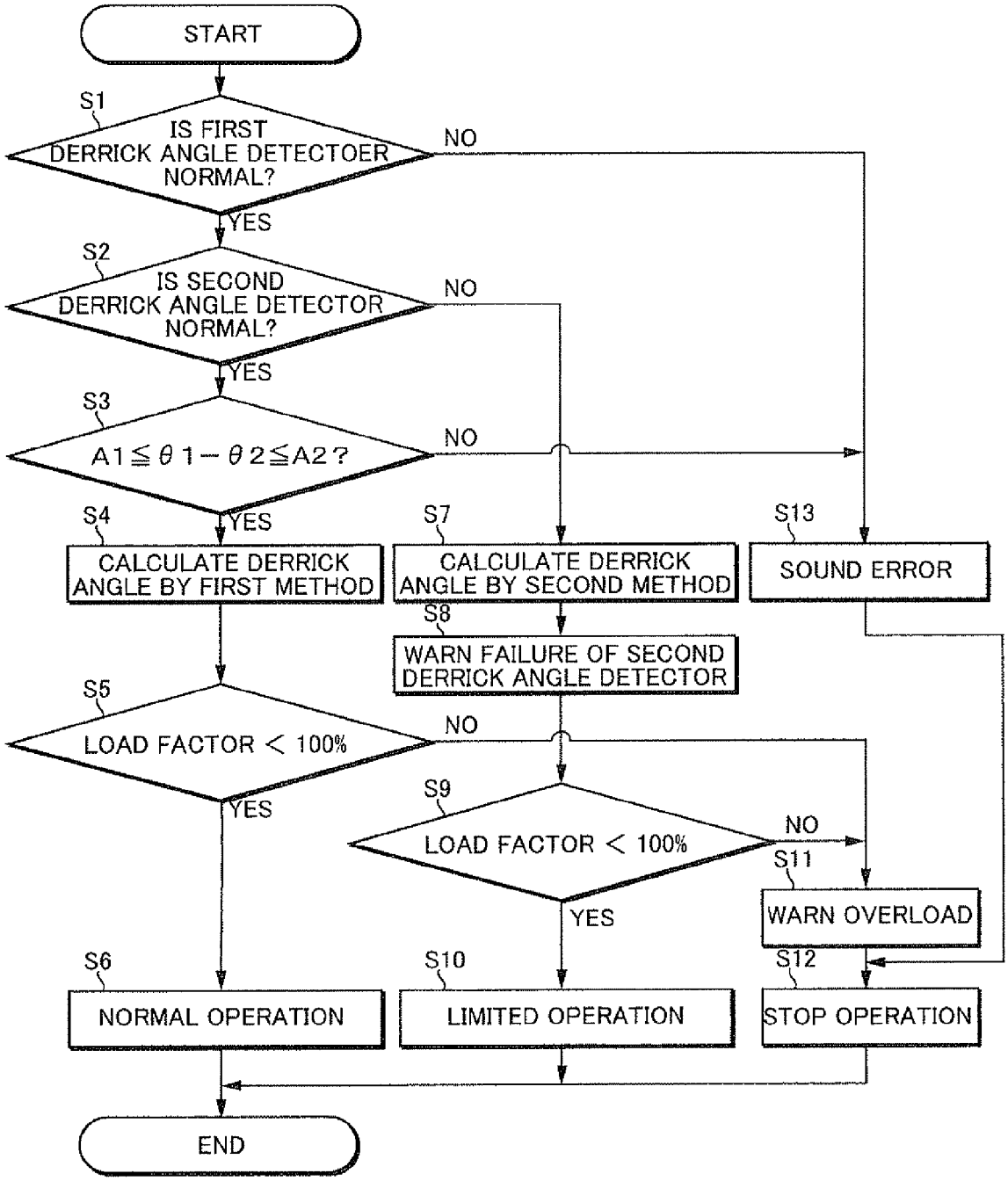
FIG. 5 is a flowchart showing a process of operation control.
Figure 6:
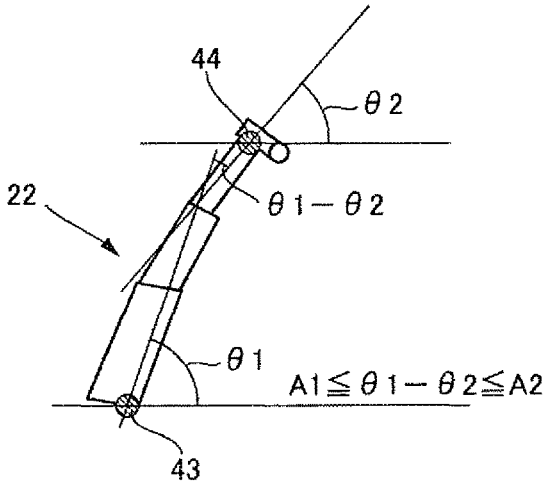
FIG. 6 shows the boom in a flexural state.
Figure 7:
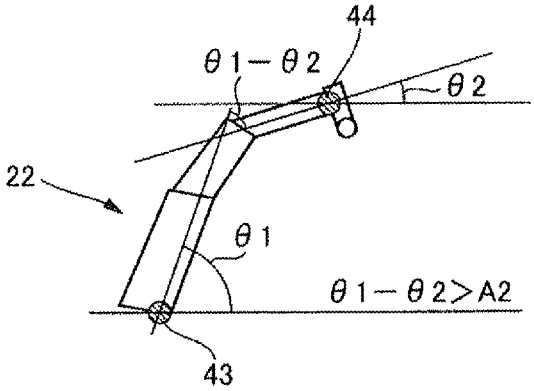
FIG. 7 shows the boom in a flexural state.
Figure 8:
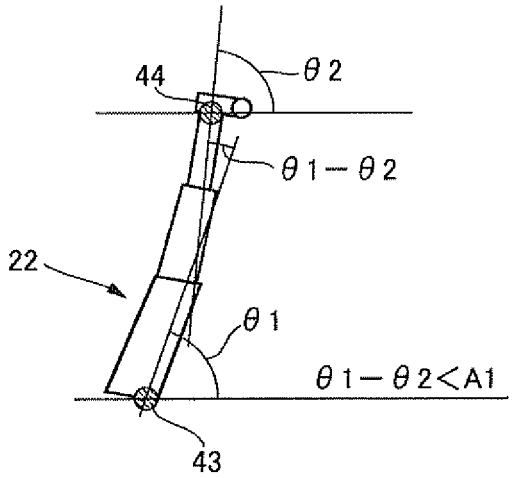
FIG. 8 shows the boom in a flexural state.

In the mobile crane 1 as a work machine, which has the above-described configuration, the controller 41 of the overload protector 40 determines whether or not the load W1 acting on the front end of the boom 22 exceeds the limit, and performs a process of operation control to control crane operation, as shown in FIG. 5.

(Step 1)

In step S1, the CPU determines whether or not the first derricking angle detector 43 is in the normal state. When determining that the first derricking angle detector 43 is in the normal state, the CPU moves the step to step S2. On the other hand, when determining that first derricking angle detector 43 is not in the normal state, the CPU moves the step to step S13. Here, the case in which the first derricking angle detector 43 is not in the normal state is, for example, a case in which the signal wire of the first derricking angle detector 43 is broken, and therefore the signal indicating the angle is not inputted, or a case in which the detected angle θ1 is out of a predetermined range of the angles due to the failure of the attachment of the first derricking angle detector 43 or a bad condition of the boom member 22*a*, such as deformation.

(Step S2)

When determining that the first derricking angle detector 43 is in the normal condition in the step S1, the CPU determines whether or not the second derricking angle detector 44 is in the normal condition in the step 2. When determining that the second derricking angle detector 44 is in the normal condition, the CPU moves the step to step S3. On the other hand, when determining that the second derricking angle detector 44 is not in the normal condition, the CPU moves the step to step S7. Here, the case in which the second derricking angle detector 44 is not in the normal state is, for example, a case in which the signal wire of the second derricking angle detector 44 is broken, and therefore the signal indicating the angle is not inputted, or a case in which the detected angle θ2 is out of a predetermined range of the angles due to the failure of the attachment of the second derricking angle detector 44 or a bad condition of the boom member 22*d*, such as deformation.

(Step S3)

When determining that the second derricking angle detector 44 is in the normal state in the step S2, the CPU determines whether or not the difference (θ1−θ2) between the detected angle θ1 by the first derricking angle detector 43 and the detected angle θ2 by the second derricking angle detector 44 is within the range from a first predetermined value A1 (e.g. −10 degrees) to a second predetermined value A2 (e.g. 30 degrees) (A1≤θ1−θ2≤A2). When determining that θ1−θ2 is within A1≤θ1−θ2≤A2, the CPU moves the step to step S4. On the other hand, when determining that θ1−θ2 is not within A1≤θ1−θ2≤A2, the CPU moves the step to the step S13. Here, the case in which the difference (θ1−θ2) between the detected angle θ1 by the first derricking angle detector 43 and the detected angle θ2 by the second derricking angle detector 44 is within the range from the first predetermined value A1 to the second predetermined value A2 (A1≤θ1−θ2≤A2) means that the flexible volume of the boom 22 is normal (see FIG. 6). On the other hand, when the difference (θ1−θ2) between the detected angle θ1 by the first derricking angle detector 43 and the detected angle θ2 by the second derricking angle detector 44 is smaller than the first predetermined value A1 (FIG. 8), or greater than the second predetermined value A2 (FIG. 7), there are possibilities that a boom member is deformed or a bolt used to form a boom member is loosened.

(Step S4)

When determining that the difference between the detected angle θ1 by the first derricking angle detector 43 and the detected angle θ2 by the second derricking angle detector 44 is within the range from the first predetermined value A1 to the second predetermined value A2 in the step S3, the CPU calculates the derricking angle θ of the boom 22 using the first method, and moves the step to step S5.

(Step S5)

In the step S5, the CPU calculates the working radius R based on the derricking angle θ of the boom 22, which is calculated in the step S4, and determines whether or not the load factor l for the calculated working radius is smaller than 100%. When determining that the load factor l is smaller than 100%, the CPU moves the step to step S6. On the other hand, when determining that the load factor l is not smaller than 100%, the CPU moves the step to step S11.

(Step S6)

When determining that the load factor l is smaller than 100% in the step S5, the CPU determines that the crane is operated at a normal working speed and ends the process of operation control in the step S6.

(Step S7)

When determining that the second derricking angle detector 44 is not in the normal condition in the step S2, the CPU calculates the derricking angle θ of the boom 22 using the second method in the step S7 and moves the step to step S8.

(Step S8)

In the step S8, the CPU displays that the second derricking angle detector 44 fails on the display part 48, sounds an alarm from the speaker 49, and moves the step to step S9.

(Step S9)

In the step S9, the CPU calculates the working radius R based on the derricking angle θ of the boom 22, which is calculated in the step S7, and determines whether or not the load factor l for the calculated working radius R is smaller than 100%. When determining that the load factor l is smaller than 100%, the CPU moves the step to step S10. On the other hand, when determining that the load factor l is not smaller than 100%, the CPU moves the step to the step S11.

(Step 10)

When determining that the load factor is smaller than 100% in the step S9, the CPU reduces the working speed of the crane to a speed that is lower than the normal working speed, allows the crane to operate only in the direction in which the load factor l decreases in the step S10, and then ends the process of operation control. Here, the operation in the direction in which the load factor l decreases includes operation to increase the derricking angle of the boom 22, operation to reduce the telescopic length of the boom 22, and operation to unreel the wire rope 23 of the winch 24.

(Step S11)

When determining that the load factor l is not smaller than 100% in the step S5, or when determining that the load factor l is not smaller than 100% in the step S9, the CPU displays the overload on the display part 48, sounds an alarm from the speaker 49, and then moves the step to step S12.

(Step S12)

In the step S12, the CPU stops the crane operation and ends the process of operation control.

(Step S13)

When determining that the first derricking angle detector 43 is not in the normal condition in the step S1, or when determining that θ1−θ2 is not within the range from the first predetermined value A1 to the second predetermined value A2 in the step S3, the CPU displays that the crane cannot work in an error condition on the display 48, sounds an alarm from the speaker 49 in the step S13, and then moves the step to the step S12.

As described above, the work machine according to the present embodiment can switch between the first method of acquiring the flexing angle α of the boom 22 based on the detected angle θ1 by the first derricking angle detector 43 and the detected angle θ2 by the second derricking angle detector 43, and second method of acquiring the flexing angle α of the boom 22 based on the detected angle θ1 by the first derricking angle detector 43. By this means, even if the second derricking angle detector 44 cannot detect the derricking angle θ2, it is possible to acquire the correct working radius R of the boom 22 based on the flexing angle α of the boom 22, which is acquired by the second method. Therefore, it is possible to continue the work safely and improve the working efficiency.

In addition, when the difference (θ1−θ2) between the detected angle θ1 by the first derricking angle detector 43 and the detected angle θ2 by the second derricking angle detector 44 is not within the range from the first predetermined value A1 to the second predetermined value A2 (A1≤θ1−θ2≤A2), the acquisition of the flexing angle α is restricted. By this means, it is possible to detect abnormal conditions, including deformation of the boom members 22*a*, 22*b*, 22*c* and 22*d*, and the failure of the attachment of the first derricking angle detector 43 or the second derricking angle detector 44, based on the detected angle θ1 by the first derricking angle detector 43 or the detected angle θ2 by the second derricking angle detector 44. Consequently, it is possible to improve the safety during the crane work.

Moreover, when the first derricking angle detector 43 is in the normal condition, but the second derricking angle detector 44 is not in the normal condition, it is possible to acquire the flexing angle α of the boom 22 by the second method. By this means, even if the first method is not available to acquire the flexing angle α of the boom 22 because the second derricking angle detector 44 fails, the second method is available to acquire the flexing angle α instead. However, the first method normally has a priority to acquire the flexing angle α of the boom 22, and therefore it is possible to acquire a precise flexing angle α at normal times.

In addition, in the situation where the second method is available to acquire the flexing angle α of the boom 22 instead of the first method, the flexing angle α of the boom 22 is automatically acquired by the second method. By this means, even if the first method is not available to acquire the flexing angle α of the boom 22, the second method is available to acquire the flexing angle α of the boom 22 instead to continue the crane operation. Consequently, it is possible to improve the working efficiency.

Moreover, when the first derricking angle detector 43 is not in the normal condition, the acquisition of the flexing angle α of the boom 22 is restricted. By restricting the acquisition of the flexing angle α of the boom 22, therefore it is possible to stop the crane operation, and consequently improve the safety.

Figure 9:
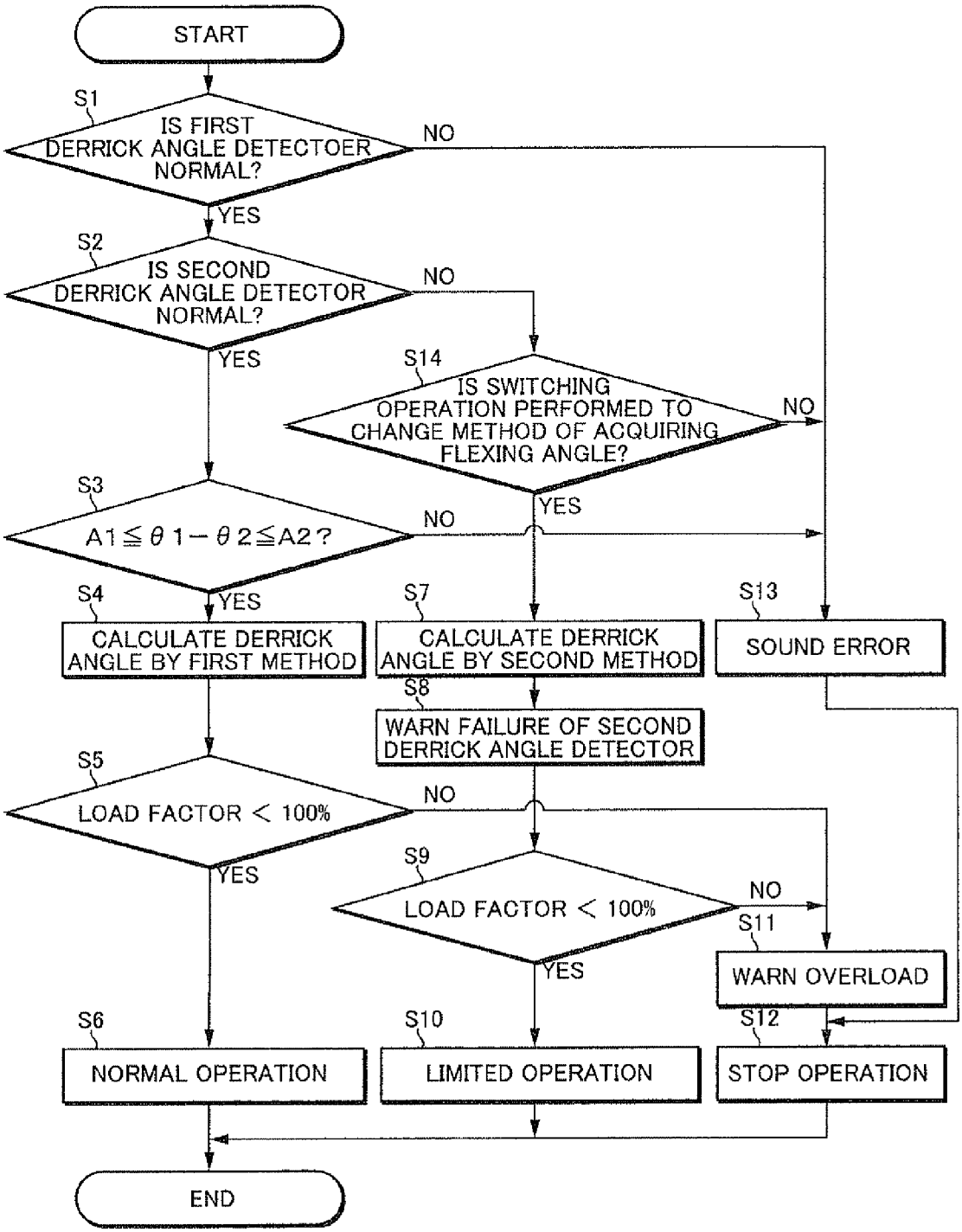
FIG. 9 is a flowchart showing a process of operation control according to another embodiment of the present invention.

FIG. 9 shows another embodiment of the present invention.

This mobile crane 1 is configured to be able to switch to the second method of acquiring the flexing angle α of the boom 22 by the user who operates the operation input part 42, when the CPU determines that the second derricking angle detector 44 is not in the normal condition in the step 2 of the process of operation control in the above-described embodiment.

As shown in FIG. 9, when determining that the second derricking angle detector 44 is not in the normal condition in the step S2, the CPU determines whether or not switching operation has been performed to change the method of acquiring the flexing angle in step S14. When determining that the switching operation has been performed to change the method of acquiring the flexing angle, the CPU moves the step to step S7. On the other hand, when determining that the switching operation has not been performed to change the method of acquiring the flexing angle, the CPU moves the step to step S13.

In this way, with the work machine according to the present embodiment, even if the second derricking angle detector 44 cannot detect the derricking angle θ2, it is possible to acquire the correct working radius R of the boom 22 based on the flexing angle α of the boom 22, which is acquired by the second method in the same way in the above-described embodiment. Therefore, it is possible to continue the work safely, and consequently improve the working efficiency.

In addition, in the situation where the flexing angle α of the boom 22 can be acquired by the second method, the user can select the second method. By this means, even if it is not possible to acquire the flexing angle α of the boom 22 by the first method, the second method can be selected by the user to acquire the flexing angle α of the boom 22. Therefore, it is possible to acquire the flexing angle α of the boom 22 by the second method after checking the condition of the boom, and consequently improve the safety.

Moreover, in the mobile crane 1 according to the embodiments, the controller 41 of the overload protector 40 performs error determination processing to determine whether or not the difference between the flexible volume acquired by the first method and the flexible volume acquired by the second method is within a predetermined range.

When determining that the difference between the flexible volume acquired by the first method and the flexible volume acquired by the second method is within a predetermined range, the controller 41 performs the process of operation control. On the other hand, when determining that the difference between the flexible volume acquired by the first method and the flexible volume acquired by the second method is not within a predetermined range, the controller 41 displays that the first derricking angle detector 43 or the second derricking angle detector 44 fails, or the overload detector 40 fails, on the display part 48.

At this time, in order to allow only the operation to reduce the load factor, the controller 41 may restrict the crane operation to the operation to increase the derricking angle of the boom 22, the operation to reduce the telescopic length of the boom 22, and the operation to unreel the wire rope 23 of the winch 24.

In this way, the controller 41 determines whether or not the difference between the flexible volume acquired by the first method and the flexible volume acquired by the second method is within a predetermined range. By this means, it is possible to detect the failure of the first derricking angle detector 43 or the second derricking angle detector 44, and the failure of the overload protector 40, and therefore improve the safety.

Here, with the embodiments, a configuration has been described where the CPU determines whether or not the difference (θ1−θ2) between the detected angle θ1 by the first derricking angle detector 43 and the detected angle θ2 by the second derricking angle detector 44 is within the range from the first predetermined value A1 to the second predetermined value A2 (A1≤θ1−θ2≤A2), and, when θ1−θ2 is not within A1≤θ1−θ2≤A2, the CPU determines that the flexible volume of the boom 22 is abnormal. However, it is by no means limiting. For example, the range for which the CPU determines that the flexible volume of the boom 22 is abnormal may be calculated in advance, according to the derricking angle of the boom member 22*a*, the telescopic length L of the boom 22 and the load of goods. Alternatively, in order to determine the range for which the CPU determines that the flexible volume of the boom 22 is abnormal, the derricking angle of the boom member 22*a*, the telescopic length L of the boom 22 and the load of goods are actually measured and stored, and then used according to the condition of the boom 22. Particularly, for the boom 22 having the minimum telescopic length, it is possible to easily detect the flexible volume being abnormal by narrowing the range for which the CPU determines that the flexible volume of the boom 22 is abnormal.

In addition, with the embodiments, a configuration has been described where the crane apparatus 20 has a telescopic boom 22. However, the present invention is applicable to a crane apparatus has a boom with a fixed length. In this case, it is not necessary to consider the telescopic length of the boom as a variable to acquire the flexing angle $\alpha$ and calculate the working radius R.

Moreover, with the embodiments, although a configuration has been described where the first derricking angle detector 43 is provided on the base end of the bottom boom member 22*a*, and the second derricking angle detector 44 is provided on the front end of the top boom member 22*d*, this is by no means limiting. When an auxiliary jib is attached to the front end of the top boom member 2*d* of the boom 22, the flexing angle may be acquired by a derricking angle detector provided in the auxiliary jib, in addition to the derricking angle detector provided in the boom 22. For example, when the auxiliary jib can perform derricking movement with respect to the boom 22, the derricking angle detectors may be provided on the base end and the front end of the auxiliary jib, respectively, and therefore it is possible to acquire the respective flexing angles of the boom 22 and the auxiliary jib. Meanwhile, when the auxiliary jib is fixed to the boom 22, a derricking angle detector is provided on the front end of the auxiliary jib, and the flexing angle of the auxiliary jib may be acquired from the derricking angle detector 44 provided on the front end of the boom 22 and also the derricking angle detector provided on the auxiliary jib.

Moreover, with the above-described embodiments, a configuration has been described where the rated load Wm for the working radius R of the boom 22 is acquired. However, the rated load Wm is changed depending on the position in which the boom 22 swivels with respect to the vehicle 10 as well as the working radius R of the boom 22, and therefore the rated load Wm for the working radius R at the position in which the boom 22 swivels may be acquired.

In addition, with the embodiments, although a configuration has been described where the present invention is applied to the mobile crane 1, this is by no means limiting. The present invention is applicable to an aerial work platform having a boom provided with a bucket at the front end of the boom, as long as the boom can perform derricking movement.

Moreover, with the embodiments, the working speed of the crane is lower than the normal working speed, and the operation is allowed only in the direction in which the rated load 1 decreases, in the step 10 of the process of operation control. However, it is by no means limiting. For example, the working speed may be reduced without restricting the direction in which the crane operates, or the direction in which the crane operates may be restricted without restricting the working speed of the crane.

The invention claimed is:

1. A work machine with a boom that can be derricked, comprising:

a first derricking angle detector configured to detect a derricking angle of the boom at a base end of the boom;

a second derricking angle detector configured to detect a derricking angle of the boom at a front end of the boom;

a first flexible volume acquisition part configured to acquire a flexible volume of the boom based on a detected angle by the first derricking angle detector and a detected angle by the second derricking angle detector;

a second flexible volume acquisition part configured to acquire a flexible volume of the boom based on the detected angle by the first derricking angle detector; and a switching part configured to switch between acquisition of the flexible volume of the boom by the first flexible volume acquisition part and acquisition of the flexible volume of the boom by the second flexible volume acquisition part when the flexible volume of the boom is acquired.

2. The work machine according to claim 1, further comprising:

a first condition determination part configured to determine whether or not the first derricking angle detector is in a normal condition, based on a result of detection by the first derricking angle detector;

a second condition determination part configured to determine whether or not the second derricking angle detector is in a normal condition, based on a result of detection by the second derricking angle detector;

a first execution part configured to execute acquisition of the flexible volume of the boom by the first flexible volume acquisition part, when the first condition determination part determines that the first derricking angle detector is in the normal condition and the second condition determination part determines that the second derricking angle detector is in the normal condition; and a first restriction part configured to restrict acquisition of the flexible volume of the boom by the first flexible volume acquisition part when a difference between the detected angle by the first derricking angle detector and the detected angle by the second derricking angle detector is out of a predetermined range.

3. The work machine according to claim 2, further comprising an allowing part configured to allow the second flexible volume acquisition part to acquire the flexible volume of the boom, when the first condition determination part determines that the first derricking angle detector is in the normal condition but the second condition determination part determines that the second derricking angle detector is not in the normal condition.

4. The work machine according to claim 3, further comprising a second execution part configured to execute acquisition of the flexible volume of the boom by the second flexible volume acquisition part, when the allowing part allows the second flexible volume acquisition part to acquire the flexible volume of the boom.

5. The work machine according to claim 4, further comprising an acquisition restriction part configured to restrict acquisition of the flexible volume of the boom when the first condition determination part determines that the first derricking angle detector is not in the normal condition.

6. The work machine according to claim 3, further comprising a selecting part configured to allow the second flexible volume acquisition part to be selected to acquire the flexible volume of the boom, when the allowing part allows the second flexible volume acquisition part to acquire the flexible volume of the boom.

7. The work machine according to claim 6, further comprising an acquisition restriction part configured to restrict acquisition of the flexible volume of the boom when the first condition determination part determines that the first derricking angle detector is not in the normal condition.

8. The work machine according to claim 3, further comprising an acquisition restriction part configured to restrict acquisition of the flexible volume of the boom when the first condition determination part determines that the first derricking angle detector is not in the normal condition.

9. The work machine according to claim 2, further comprising an acquisition restriction part configured to restrict acquisition of the flexible volume of the boom when the first condition determination part determines that the first derricking angle detector is not in the normal condition.

10. The work machine according to claim 1, wherein the first flexible volume acquisition part calculates the flexible volume of the boom based on a relationship among a difference between a result of detection by the first derricking angle detector and a result of detection by the second derricking angle detector, the derricking angle of the boom, and a length of the boom.

11. The work machine according to claim 1, wherein the second flexible volume acquisition part stores a moment acting around a base point from which the boom performs derricking movement and a flexing angle, for each telescopic length and also for each derricking angle of the boom, and outputs the flexing angle based on a result of detection by the first derricking angle detector.

12. The work machine according to claim 1, further comprising an error determination part configured to determine whether or not a difference between the flexible volume acquired by the first flexible volume acquisition part and the flexible volume acquired by the second flexible volume acquisition part is within a predetermined range.

* * * * *